US005244405A

United States Patent [19]

Broschard, III et al.

[11] Patent Number: 5,244,405

[45] Date of Patent: Sep. 14, 1993

[54] CONNECTOR WITH REMOVABLE UNKEYED INSERT AND REMOVABLE UNKEYED INSERT THEREFOR

[75] Inventors: John L. Broschard, III, Harrisburg; Robert H. Frantz, Newville, both of Pa.

[73] Assignee: AMP Incorporated, Harrisburg, Pa.

[21] Appl. No.: 933,268

[22] Filed: Aug. 21, 1992

[51] Int. Cl.[5] ..... H01R 13/627

[52] U.S. Cl. ..... 439/362; 439/906

[58] Field of Search ..... 439/359, 362, 363, 607, 439/608, 609, 610, 677, 680, 681, 540, 906

[56] References Cited

U.S. PATENT DOCUMENTS

| | | | |
|---|---|---|---|
| 2,902,665 | 9/1959 | D'Amico . | |
| 3,056,942 | 10/1962 | Carbaugh et al. | 439/362 |
| 3,187,292 | 6/1965 | Small et al. | 439/362 X |
| 4,181,391 | 1/1980 | Kilsdonk | 439/363 |
| 4,832,624 | 5/1989 | Waters et al. | 439/680 |
| 4,895,535 | 1/1990 | Emadi et al. | 439/681 |
| 4,929,184 | 5/1990 | Emadi et al. | 439/681 |

*Primary Examiner*—Larry I. Schwartz
*Assistant Examiner*—Khiem Nguyen
*Attorney, Agent, or Firm*—David L. Smith

[57] ABSTRACT

An unkeyed insert (4) removably retained in a electrical connector (2) has a mating portion (44) projecting from a forward face of the connector beside a mating structure (12) also projecting from the forward face of the connector (2). The mating part (44) defines a socket (60) for receiving a screw lock (234) on a mating connector (200). The mating part (44) has an open side (58) closely adjacent to the mating structure (12). By virtue of its rectangular shape, the mating part (44) can only be angularly oriented with its open side facing the mating structure (12). The unkeyed insert (4) cannot be mated with a keyed structure (218) of the mating connector (200) since an end face (62) of the mating part (44) would butt against the distal end of a rib (222) of the keyed structure (218).

12 Claims, 6 Drawing Sheets

CONNECTOR WITH REMOVABLE UNKEYED INSERT AND REMOVABLE UNKEYED INSERT THEREFOR

BACKGROUND OF THE INVENTION

This invention relates to an electrical connector having a removable unkeyed insert and to a removable unkeyed insert for the connector.

There is disclosed in U.S. Pat. No. 4,929,184, an electrical connector having a key for mating with a keying structure of a mating electrical connector. The key comprises a key member having a hexagonal body section seated in a aperture of a flange of the connector, the key having a keying projection extending from the body section and being shaped as an elongate semi-cylindrical hood having an arcuate inner surface. A jack screw extends through the hexagonal body section from the rear, and has a screw threaded shank along the semi-cylindrical surface of the hood. A key having a similar kind of semi-cylindrical keying projection is also disclosed in U.S. Pat. No. 2,902,665 and U.S. Pat. No. 4,895,535. U.S. Pat. No. 4,832,624 discloses a connector having a key having a body section adapted to be received within a slot in a lower back shell of the connector. The key includes a keying section projecting from the body section and being of solid, semi-circular cross-section.

SUMMARY OF THE INVENTION

The present invention is intended to provide a keying insert for an electrical connector, which can mate with an unkeyed projection, for a example a lock screw projecting from a mating connector but cannot mate with a keying structure thereof. Such an unkeyed insert is of particular use with a connector that is intended to mate with one of a pair of stacked connectors having screw locks projecting therefrom, but not with the other connector of the stacked pair which has keying structures projecting therefrom.

According to one aspect of the invention, an electrical connector having a forward end and a mating structure projecting from the forward end has an unkeyed insert removably secured in the connector. The insert has a mating part projecting forwardly from the forward end of the connector beside the mating structure. The mating part of the unkeyed insert comprises top and bottom walls and a single side wall extending orthogonally with respect to the top and bottom walls. These walls define a socket opening forwardly of the forward end of the connector and having an open side bounded by lateral end faces of the top and bottom walls. The unkeyed insert is securable in the connector only with the lateral end faces of the top and bottom walls closely proximate to, and facing, the mating structure.

Although the socket can receive an unkeyed mating member, for example a lock screw securing a mating electrical connector to a panel, it cannot receive a keying structure having a projection such as a keying rib, since if it be essayed to mate the unkeyed insert with the keying structure, the forward end of a respective one of the walls of the mating part of the unkeyed insert will butt against the distal end of the projection or rib.

By virtue of its rectangular shape, the keying insert cannot be angularly oriented with respect to the mating structure excepting with the open side of the mating portion facing the mating structure of the connector, since the walls of the mating part of the unkeyed insert would otherwise interfere with the mating structure.

Since the unkeyed insert is removable from the connector, it can be exchanged for a keyed insert where the connector is intended to mate with a mating connector having a keying structure which is compatible with the keyed insert.

According to another aspect of the invention an unkeyed insert for removable retention in a first electrical connector to mate with an unkeyed mating member projecting from a mating second electrical connector, comprises a mating part for mating with the unkeyed mating member. The mating part has top and bottom walls, a single side wall extending orthogonally with respect to the top and bottom walls and a rear wall extending orthogonally with respect to the top and bottom walls. These walls co-operate to define a socket having an open end for receiving the unkeyed mating member and an open side opposite to the single side wall of the mating part. The open side is bounded by substantially coplanar lateral end faces of the top and bottom walls and of the rear wall. The unkeyed insert further comprises an anchoring part for retaining it in the first connector with the mating part projecting from a forward end of the connector.

The anchoring part of the unkeyed insert preferably has a bore communicating with the socket, for receiving a jack screw with a screw threaded shank of the jack screw projecting into the socket for meshing with a tapped bore in the unkeyed mating member.

DETAILED DESCRIPTION OF THE PREFERRED EMBODIMENT OF THE INVENTION

Figure 3:
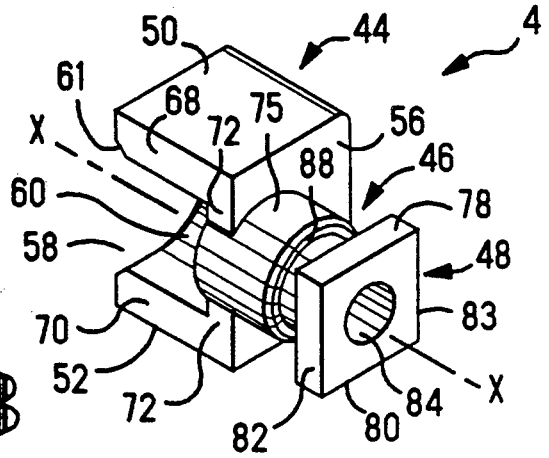
FIG. 3 is an enlarged isometric view of the unkeyed insert taken from the rear.
Figure 4:
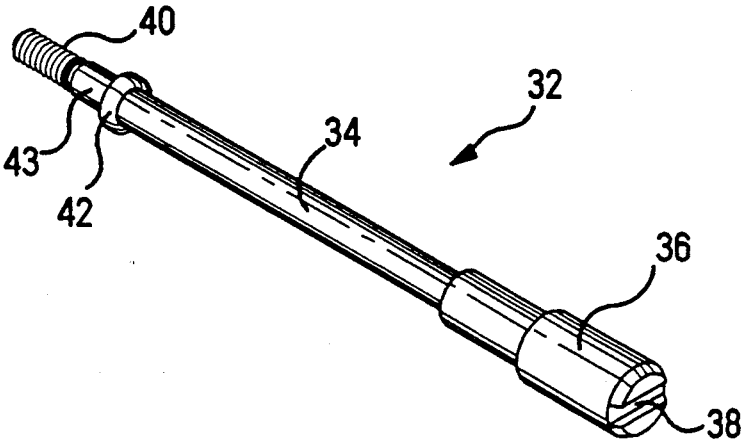
FIG. 4 is an enlarged isometric view of a jack screw associated with a respective one of said inserts.
Figure 5:
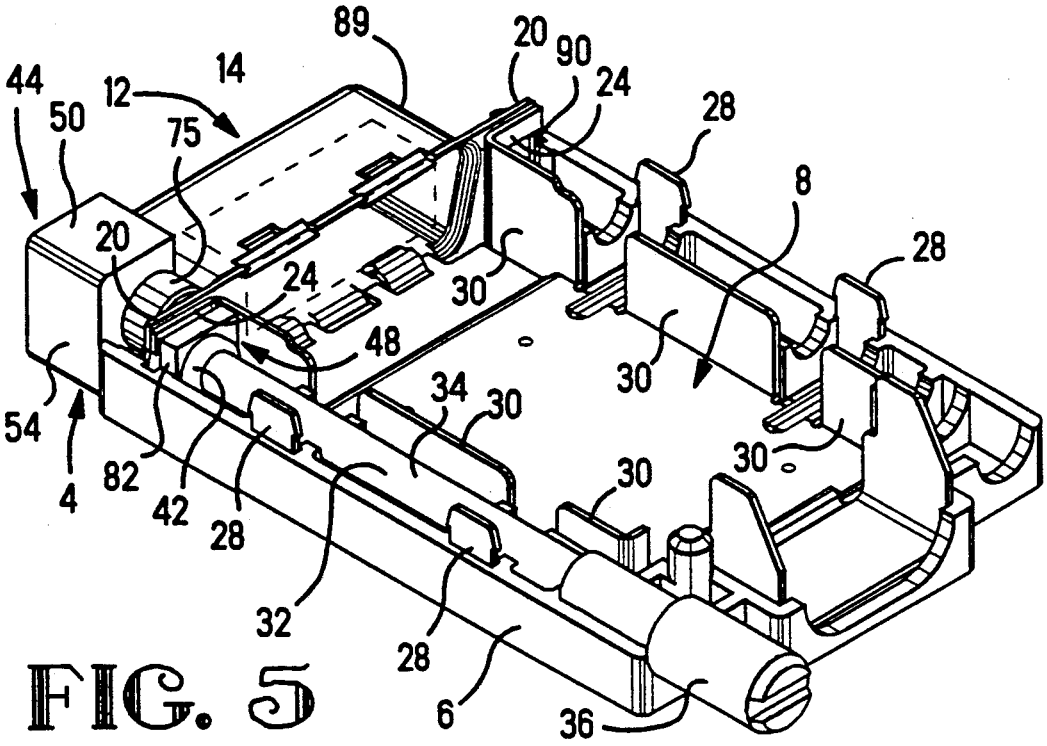
FIG. 5 is an isometric view of a lower back shell and cover assembly of the connector of FIG. 1 showing one of the unkeyed inserts and a jack screw associated therewith in place in the assembly.
Figure 6:
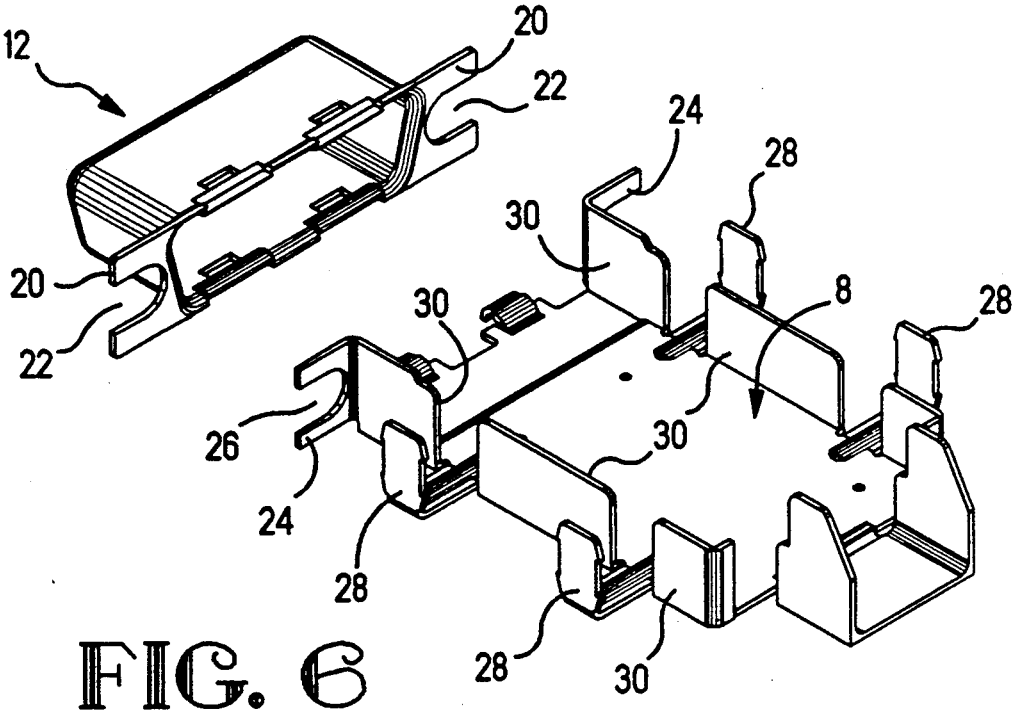
FIG. 6 is an exploded isometric view illustrating details of the assembly of FIG. 5.

Reference will first be made to FIGS. 1 to 5 A shielded, cable side electrical connector 2 incorporates a pair of removable, unkeyed metal inserts 4 according to the present invention, but is otherwise constructed according to the teaching of U.S. Pat. application Ser. No. 766,889 filed Sep. 27, 1977 now U.S. Pat. No. 5,158,474, the disclosure of which Application is hereby incorporated herein by reference. The connector 2 comprises upper and lower insulating covers 5 and 6, respectively, enclosing an upper back shell (not shown) and a lower back shell 8 which is shown in FIGS. 5 and 6. A drawn metal shell 12 detachably secured to the lower back shell 8 forwardly thereof and projecting from the forward end of the connector 2, is similarly secured to the upper back shell. The drawn shell 12 receives an insulating pin header 14 ( as shown block schematically in broken lines in FIG. 5), of the sub miniature D type. There project from the pin header 14, forwardly into the shell 12, two rows of terminal pins 16 having rear ends (not shown) connected to respective conductors (not shown) of a multi-conductor electrical cable 18 extending between the back shells. The drawn shell 12 has a pair of opposed, laterally projecting flanges 20 each having a laterally opening slot 22 therein. The back shell 8 has a similar pair of opposed lateral flanges 24 having laterally opening slots 26 therein. Outriggers 28 project laterally from opposite sides of the shell 8, beyond side wall portions 30 thereof. A jack screw 32 for co-operation with a respective insert 4 as described below, is cradled in the cover 6 between the outriggers 28 and the side wall portions 30 on each side of the back shell 8, only one of the jack screws being shown in FIG. 5. Each jack screw 32 has a shaft 34 having at one end, a head 36 formed with an end kerf 38 for receiving a screwdriver blade. Each jack screw 32 has at its end remote from the kerf 38, a screw threaded shank 40 and is provided with a radically projecting collar 42 towards its end remote from the kerf 38. The shaft 34 has a short unscrewed threaded portion 43 between the collar 42 and the shank 40.

According to the preferred embodiment of the present invention, each unkeyed metal insert 4, which may, for example, be a one piece zinc casting, comprises as best seen in FIGS. 3 and 4, a rectangular mating part 44 a tubular, circular cross section shank 46 and a rectangular abutment plate 48. The mating part 44 which is of substantially square cross section, has a top wall 50 and a bottom wall 52, which are connected by a single side wall 54 and a rear end wall 56. The wall 54 extends orthogonally with respect to the walls 50, 52 and 56. The mating part 44 is forwardly open and has an open side 58. The walls 50, 52, 54, and 56 cooperate to define a socket 60, which is of arcuate cross section and communicates with the open side 58. The socket 60 has a forwardly flared chamfered mouth 61. The mating part 44 has a front face consisting of the front faces 62, 64 and 66 of the upper and lower walls 50 and 52 and the side wall 54, respectively. The open side 58 of the mating part 44 is bounded by at least substantially coplanar lateral end faces 68, 70 and 72 of the upper and lower walls 50 and 52 and of the rear wall 56, respectively. The walls 50, 52, 54, and 56 are of substantially equal overall dimensions and are substantially square.

The shank 46 has a central, circular cross section, through, smooth walled bore 74 which is coaxial with the radius of curvature of the socket 60 and which opens at its forward end into the socket 60. The shank 46 has an enlarged cross section forward part 75 and a reduced cross section rear neck 76. An abutment plate 48 is connected to the rear end of the neck 76 in a parallel relationship with the rear wall 56 of the mating part 44. The plate 48, which is square, has a top side 78, a bottom side 80 and lateral sides 82 and 83. A circular cross section, a smooth walled bore 84 extends through the plate 48 coaxial with, and communicating with, the rear end of the bore 74 of the shank 46. The forward face of the abutment plate 48 defines a shoulder 86 which is opposite to a circular shoulder 88 defined between the enlarged cross section part 75 and the neck 76 of the shank 46.

Figure 1:
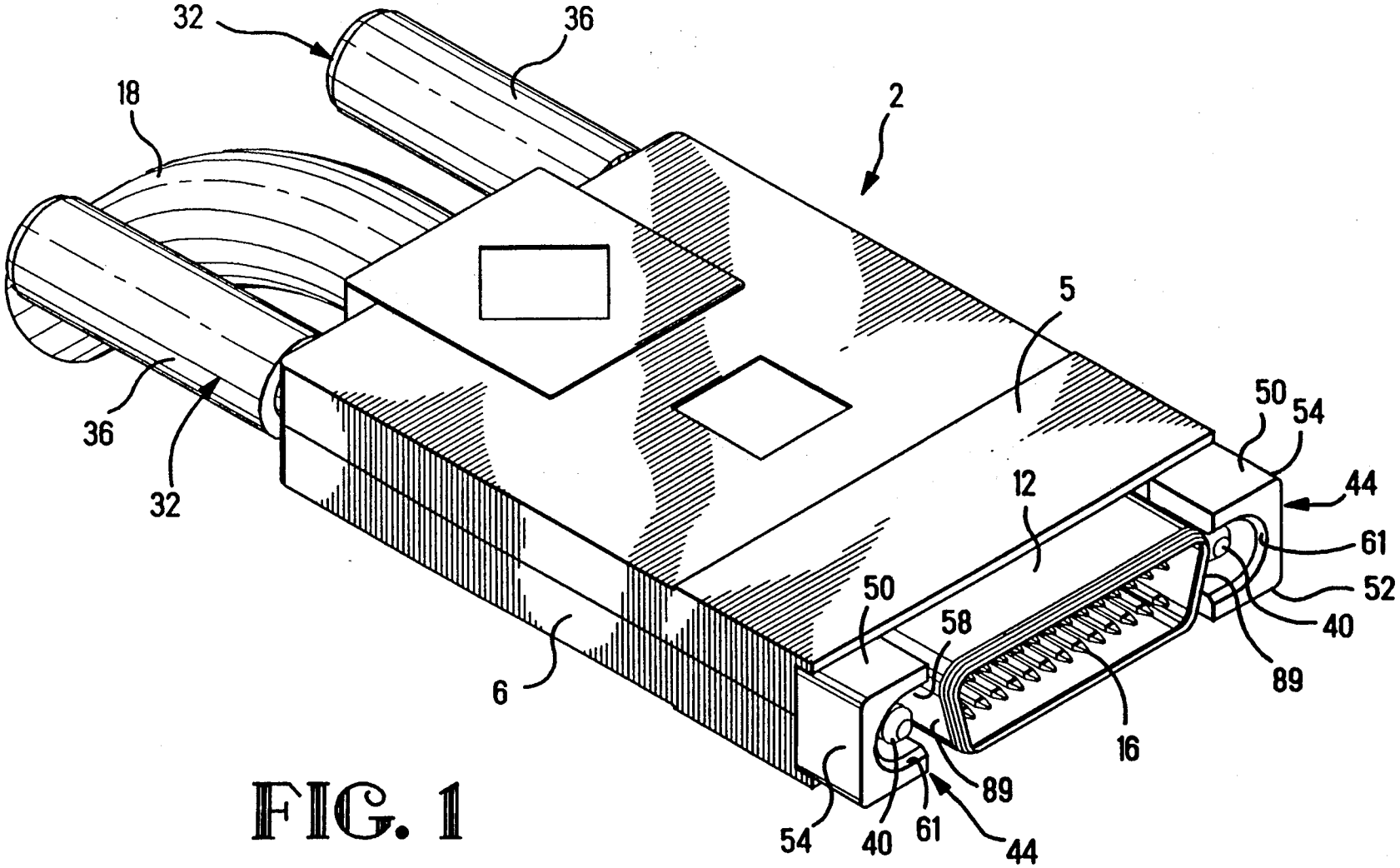
FIG. 1 is an isometric view of a shielded, cable side electrical connector to which a multi-conductor cable has been terminated, and which is provided with removable unkeyed inserts according to a preferred embodiment of the invention.
Figure 2:
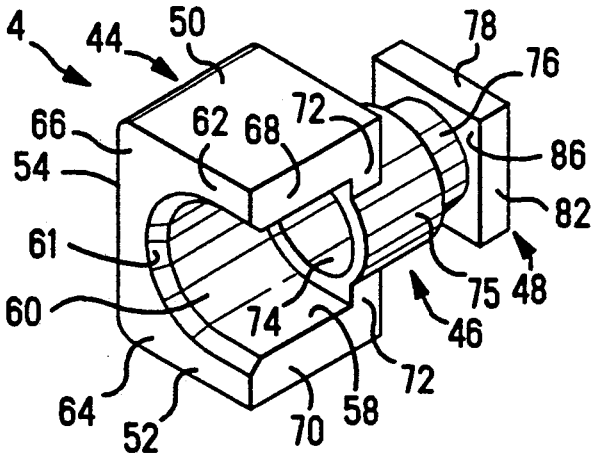
FIG. 2 is an enlarged isometric view taken from the front, of one of said unkeyed inserts.

Before the assembly together of the upper and lower back shells and the covers 5 and 6, each pair of flanges 20 and 24 on a respective side of the shells 8 and 12 is inserted between the shoulders 86 and 88 of a respective insert 4 so that its neck 76 is received in the slots 22 and 26 of the flanges 20 and 24 which are in face to face engagement with each other, the flanges 20 and 24 being snugly received between the shoulders 86 and 88. Each insert 4 is so angularly oriented about its longitudinal axis X—X (FIG. 3) that the open side 58 of the mating part 44 of the insert faces a corresponding side wall 89 of the drawn shell 12. The back shell 8 is then assembled to the lower cover 6 so that the sides 80 and 83 of the plate 48 of each insert are received in a respective L-shaped groove 90 in the cover 6 with the side 82 of the abutment plate 48 against a respective forward most side wall portion 30 of the back shell 8, the side 78 of the plate 48 being uppermost. A respective jack screw 32 is then assembled to each insert 4. The screw threaded shank 40 of the jack screw 32 is inserted through the bores 84 and 74, from the rear of the insert 4 so that the shank 40 projects into the socket 60 of the mating part 44, the smooth unthreaded portion 43 of the jack screw 32 then extending through the bores 74 and 84 and the collar 42 of the jack screw 32 abutting the rear face of the abutment plate 48 of the insert 4. Each jack screw then extends between the outriggers 28 and the side wall portions 30 of the back shell 8 on a respective side thereof. The upper back shell and upper cover 5 are then assembled to the lower back shell 8 and the lower cover 6. In the assembled condition of the cable side connector 2, the mating part 44 of the inserts 4 project from the forward end of the connector 2, forwardly of the covers 5 and 6, on each side of the drawn shell 12 as shown in FIG. 1, for mating, as described below, with screw locks of a mating connector. Each insert 4, when assembled to the connector 2, can only be angularly oriented about the axis XX of the insert 4, with the open side 58 thereof facing the drawn shell 12, that is to say with the wall 50 of the mating part 44 uppermost and the lateral end faces 60, 70 and 72 closely proximate to the drawn shell 12. If it were essayed to assemble the insert to the connector 2 in any other angular orientation, one of the walls 50, 52 or 54 of the mating part 44 would interfere with the drawn shell 12.

Figure 10:
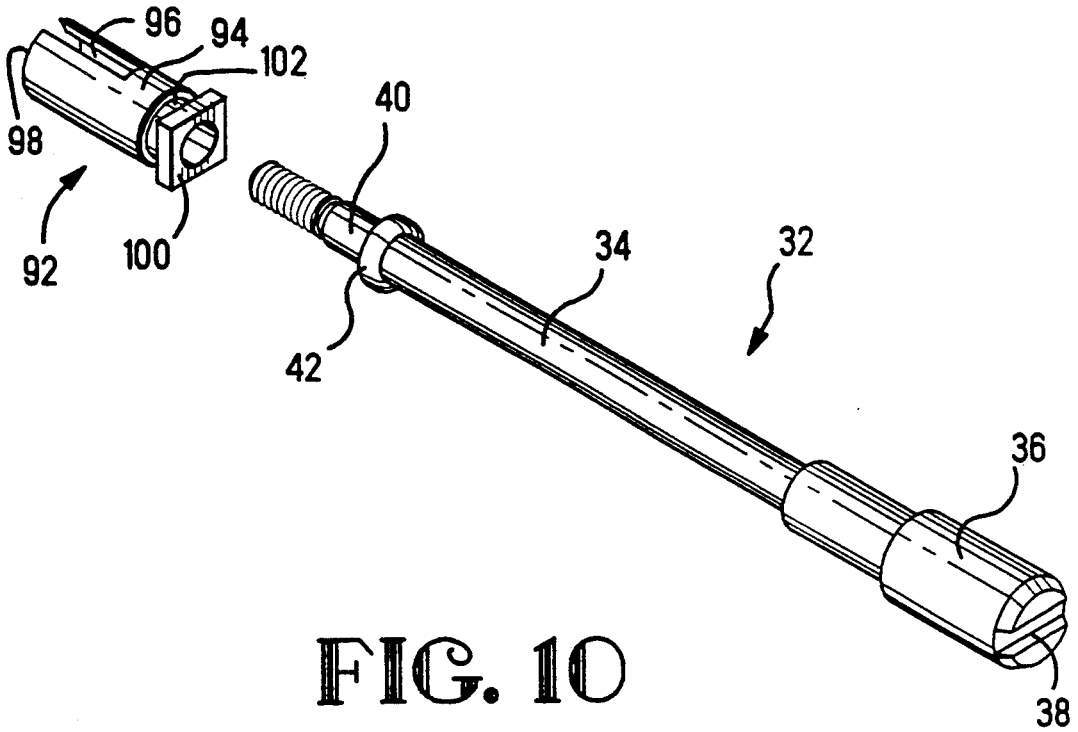
FIG. 10 is an exploded isometric view of a keyed insert receiving a jack screw.

According to the teaching of U.S. Pat. application Ser. No. 766,889 cited above, the covers and the back shells are releasably retained in their assembled condition by means of projections on the outriggers 28 which engage in openings in the upper cover 5. Thus if the connector 2 is required to be provided with keyed inserts, which are described below, instead of the unkeyed inserts 4, the back shells and the covers can be disassembled and the unkeyed inserts 4 replaced by keyed inserts 92 (one of which is shown in FIG. 10), according to the teaching of said U.S. Pat. application Ser. No. 766,899. Each keyed insert 92 comprises tubular keying shaft 94 having a blind, axial, keying slot 96 opening into its forward end 98, which is open. A neck (not shown) having a through bore communicating with the interior of the shaft 94 projects a rear wall 102 thereof and has at its rear end, a square keying abutment plate 100 which is identical with the abutment plates 48 of the unkeyed inserts 4. The keyed inserts 92 are mounted to the cable side connector in the same way as the unkeyed inserts 4, that is to say with the keying shafts 94 of the inserts 92 on each side of the drawn shell 12. Since the shafts 94 of the inserts 92 are of circular cross section and are of smaller cross sectional area than the mating portions 44 of the inserts 4, the inserts 92 can be oriented in any one of four angular positions without the shafts 94 interfering with the drawn shell 12. The angular position of each keyed insert 92 is determined by which side of the keying abutment 100 is uppermost. When the keyed inserts 92 have been assembled to the back shell 8 and the cover 6, a jack screw 32 is inserted through each insert 92 from the rear, so that the screw threaded shank 40 of the jack screw is received in the interior of the tubular shaft 94 of the insert 92 with the collar 42 of the jack screw engaging against the abutment plate 100. The keyed inserts 92 are for mating with respective keying structures of the mating connector.

Figure 7:
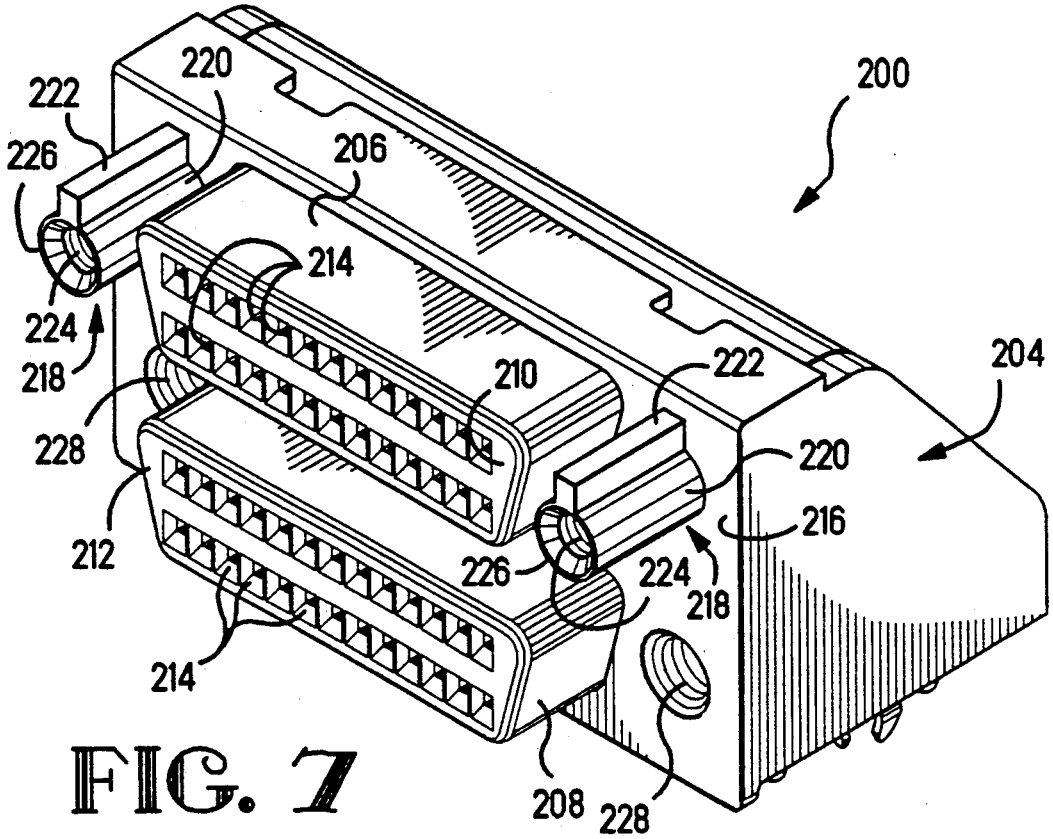
FIG. 7 is an isometric view of a shielded, right angle, electrical connector for surface mounting on a circuit board.
Figure 9:
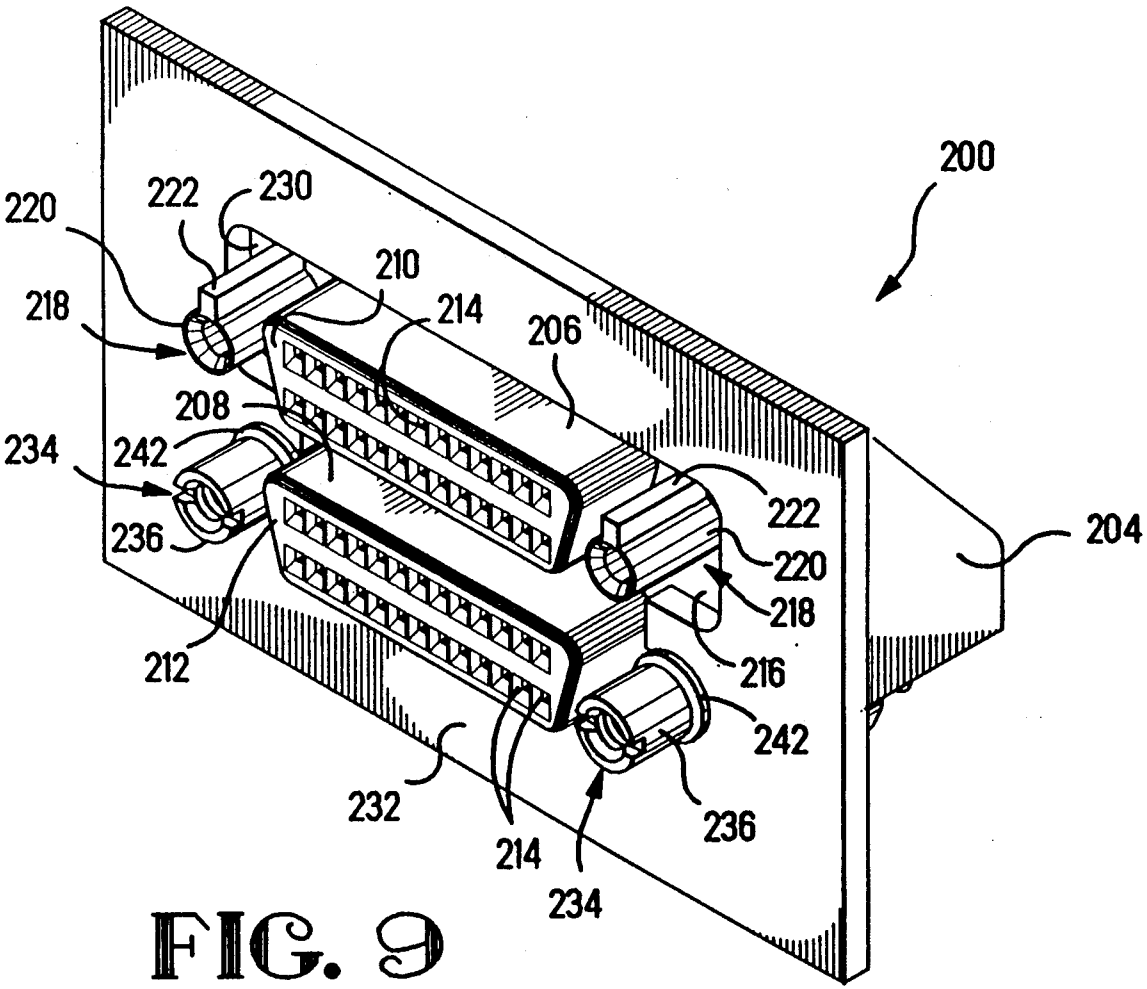
FIG. 9 is an isometric view of the connector of FIG. 7 mounted to the panel and secured thereto by means of screw locks according to FIG. 8.

The mating connector, which is generally referenced 200, in FIGS. 7 and 9, is constructed according to the teaching of U.S. Pat. application Ser. No. 853,649 filed Mar. 18, 1992 U.S. Pat. No. 5,161,99, U.S. Pat. application Ser. No. 853,565 filed Mar. 18, 1992, and U.S. Pat. application Ser. No. 07/933,266 filed Aug. 21, 1992 the disclosure of each of which Patent Applications is hereby incorporated herein by reference.

The connector 200 is a shielded, right angle connector for surface mounting on a printed circuit board. The connector 200 comprises a die cast metal housing 204 receiving upper and lower drawn metal shells 206 and 208, respectively, which in turn receive insulating upper and lower header inserts 210 and 212, respectively. The header inserts 210 and 212 each accommodates two rows of receptacle terminals (not shown) retained in cavities 214 in the header and having solder tails (not shown) depending therefrom for insertion through holes in the circuit board. Each drawn shell 206 and 208 is dimensioned for reception in the drawn shell 12 of a respective connector 2 so that the terminal pins 16 of the connector 2 mate with respective receptacle terminals of the header insert 210 of 212. The housing 204 has a front face 216 from which project normally, on opposite sides of the drawn shell 206 respective keying structures 218 each comprising a cylindrical protrusion 220 and a keying rib 222 extending axially along the external surface of the protrusion 220 and projecting radially and vertically outwardly thereof. Each protrusion 220 has a tapped axial bore 224 opening into a distal end 226 of the protrusion 220, remote from the front face 216. Below each keying structure 218 is a tapped bore 228 opening into the front face 216 of the housing 204. The bores 228 are disposed opposite sides of the drawn shell 208.

Figure 8:
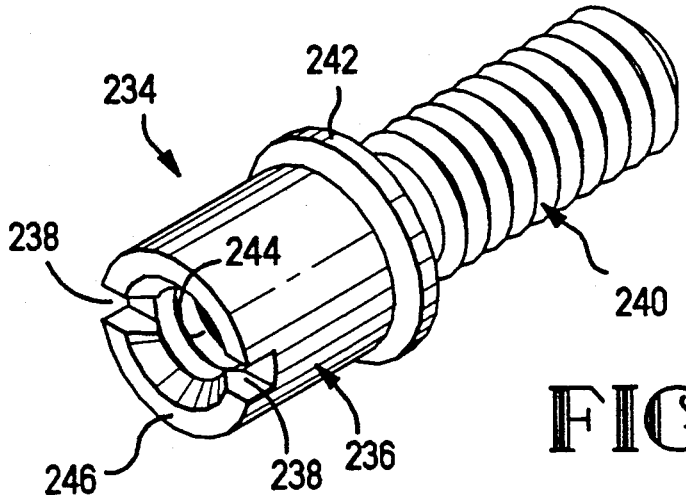
FIG. 8 is an enlarged isometric view of a screw lock for securing the connector of FIG. 7 to mounting panel.

For use thereof, the connector 200 is mounted in a cut out 230 in a mounting panel 232, as shown in FIG. 9, with the drawn shells 206 and 208 and the keying structures 218 projecting through the cut out 230 and beyond the front face of the panel 232. The connector 200 is secured to the panel 232 by means of a pair of screw locks 234. As best seen in FIG. 8, each screw lock comprises a circular cross section, elongate head 236 having kerfs 238 at one end each for receiving a screwdriver blade. At its other end, each screw lock has a threaded shank 240 meshing with a screw thread of a respective one of the tapped bores 228 in the housing 204. Between the head 236 and the shank 240, each screw lock 234 has a radially projecting collar 242 engaged against the panel 232. A tapped bore 244 opens into the distal end 246 of each screw lock 234.

The drawn shell 212 of the right angle connector 200 is intended to mate with the drawn shell 12 of a first connector 2 provided with unkeyed inserts 4, whereas the drawn shell 210 of the connector 200 is intended to mate with the drawn shell of a second connector 2 which is provided with keyed inserts 92 instead of unkeyed inserts 4. Unless the connectors are so mated, the conductors of the cable 18 will not be correctly terminated to respective receptacle terminals of the connector 200. Accordingly, each unkeyed insert 4 is so constructed and is so angularly oriented in the first connector 2, that the insert 4 can mate with a respective one of the screw locks 234 but not with either of the keying structures 218. Likewise, the keyed inserts 92 are so constructed and are so angularly oriented that they can mate with the keying structures 218 but are so dimensioned that they cannot mate with the screw locks 234.

When the drawn shell 12 of the first connector 2, having the unkeyed inserts, is to be mated with the drawn shell 208 of the connector 200, the first connector 2 is applied to the connector 200, so that the mouth 61 of the socket 60 of each unkeyed insert 4 is placed against the distal end 246 of the elongate head 236 of a respective screw lock 234 and the jack screws 32 are turned and tightened so that the screw threads of the shanks 40 of the jack screws mesh with the screw threads of the tapped bore 244 of the respective screw lock 234, whereby each screw lock 234 is received in the mating part 44 of the respective insert 4 until the chamfered mouth 61 of the insert 4 bottoms against the collar 240 of the screw lock 234, at which the time the drawn shells 12 and 208 are fully mated, the connectors 2 and 200 being tightly secured together in mating relationship by means of the screw threaded shanks 40 of the jack screws 32. Unkeyed insert 4 cannot be mated with a keying structure 218 because the upper front face 62 of the insert 4 would butt against the distal end of the rib 222 of the keying structure 218, were it essayed to mate the insert 4 with the structure 218.

As disclosed in U.S. Pat. application Ser. No. 07/933,266 filed Aug. 21, 1992 (15265) cited above, the keying structures 218 may be provided on the housing 204 so that their ribs 222 are differently angularly oriented, for use in different keying applications. However, the keying structures 218 are not angularly oriented in such a way that the rib 222 of any keying structure 218 is directed towards the shell 206, because this would leave insufficient room between the rib 222 and the shell 206 for the drawn shells to mate. Thus, in any of the angular orientations of a keying structure 18, one of the front faces 62, 64, 66 of the mating part 44 of the insert 4 will abut the distal end of the rib 222 of the keying structure 218 should it be essayed to mate the unkeyed insert 4 therewith. The inside diameter of the cavity 60 of the unkeyed insert 4 may be, for example, 0.155 inches (0.3937 cm), the outside diameter of each screw lock 234 being, for example, 0.144 inches (0.3652 cm) and the overall diameter of each keying structure 218, including its rib 212, being for example, 0.165 inches (0.4191 cm). In any event, the inside diameter of the cavity 60 is greater than the outside diameter of the screw lock and less than the overall diameter of the keying structure, in order to enable the unkeyed insert to the mate with the screw lock but not with the keying structure.

Figure 11:
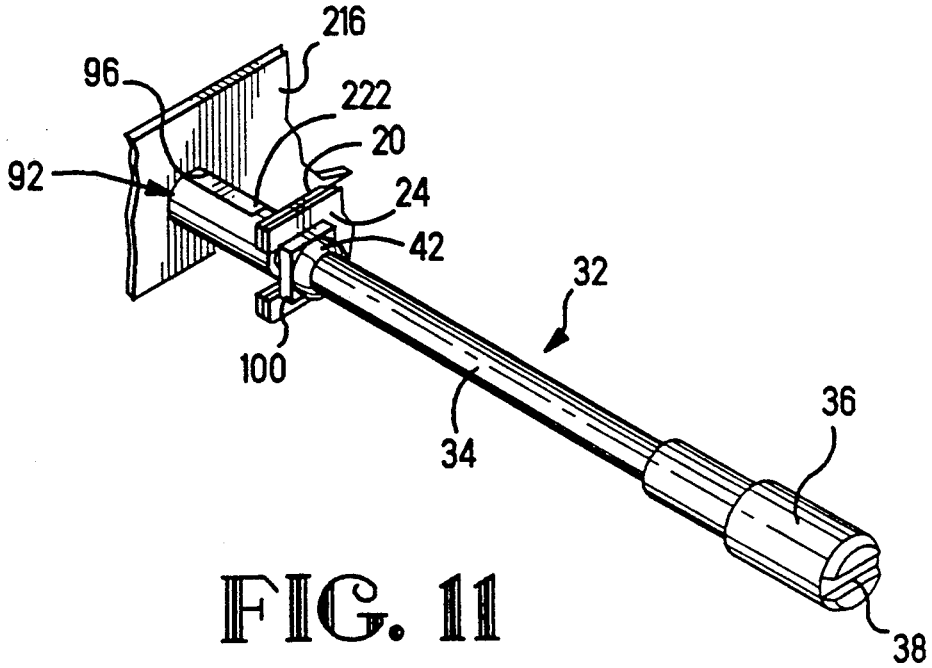
FIG. 11 is an isometric view showing the insert and jack screw of FIG. 10 when mated with a keying structure of the connector of FIGS. 7 and 9.

As shown in FIG. 11, each keyed insert 92 can mate with a respective keying structure 218 if the slot 96 of the insert 92 is appropriately angularly oriented to receive the rib 222 of the keying structure 218. The insert 92 cannot however, be mated With a screw lock 234 because the outside diameter of each screw lock 234 is greater than that of the protrusion 220 of each keying structure 218, as shown in FIG. 9, the inside diameter of the shaft 94 of each keyed insert 92, accordingly being less than the outside diameter of each screw lock 234.

What is claimed is:

1. An electrical connector having a forward end and a mating structure projecting from said forward end, at least one unkeyed insert removably secured in the connector and having a mating part projecting forwardly from said forward end beside mating structure, the mating part of said at least one unkeyed insert comprising top and bottom walls and a single side wall extending orthogonally with respect to said top and bottom walls, thereby defining a socket opening forwardly of the forward end of the connector, and having an open side bounded by lateral end faces of said top and bottom walls, the at least one unkeyed insert being securable in the connector only with said lateral end faces closely proximate to, and facing, said mating structure, said at least one unkeyed insert having a rear end wall connecting said top and bottom walls and said single side wall, a shank projecting rearwardly from said rear end wall and having a bore extending therethrough and communicating with the socket, a jack screw mounted in the connector extending through said bore and having a screw threaded shank projecting into the socket, a reduced cross-section neck projecting rearwardly from said shank, an abutment plate connected to the rear end of said neck being lodged in a recess in the connector.

2. A connector as claimed in claim 1, wherein the top and bottom walls of the mating part of the at least one unkeyed insert and the single side wall thereof are of substantially equal extent at least laterally of said mating part.

3. A connector as claimed in claim 1, wherein said mating structure comprises an external drawn metal shell having opposite side walls, the mating part of a respective unkeyed insert projecting from said forward end of the connector beside each of the side walls of the drawn metal shell.

4. A connector as claimed in claim 1, wherein said shank and said neck operate to define a shoulder facing said abutment plate.

5. A connector as claimed in claim 1, wherein said abutment plate has an opening therethrough, communicating with said bore and receiving said jack screw.

6. A connector as claimed in claim 5, wherein said connector comprises at least one internal flange, a slot opening into an end of said at least one flange and receiving said neck.

7. An unkeyed insert for removable retention in a first electrical connector to mate with an unkeyed mating member projecting from a mating second electrical connector, the unkeyed insert comprising:

a mating part for mating with the unkeyed mating member, and having a top and bottom walls, a single side wall extending orthogonally with respect to said top and bottom walls, and a rear wall extending orthogonally with respect to said top and bottom walls and said side wall, said walls defining a socket having an open end for receiving said unkeyed mating member and an open side opposite said side wall, said open side being bounded by at least substantially coplanar lateral end faces, of said top and bottom walls and said rear wall; and an anchoring part projecting rearwardly from said rear wall for retaining said unkeyed insert in said first connector with the mating part of the unkeyed insert projecting forwardly from a forward end of the first connector, said anchoring part comprising a circular cross-sectional shank connected to said end wall and supporting at its rear end, a polygonal plate extending parallel to said end wall for reception in a grove in said first connector.

8. An unkeyed insert as claimed in claim 7, wherein each of said walls is substantially square, said walls being of substantially equally overall dimensions.

9. An unkeyed insert as claimed in claim 7, wherein said anchoring part has a bore extending therethrough and communicating with said socket, for receiving a jack screw.

10. An unkeyed insert as claimed in claim 7, wherein said shank defines an external shoulder facing said polygonal plate for receiving a flange in said first connector.

11. An unkeyed insert as claimed in claim 10, wherein the polygonal plate and the shank define an axial bore communicating with the socket, for receiving a jack screw.

12. An unkeyed insert as claimed in claim 7, wherein the socket is of arcuate cross-section to receive an unkeyed mating member of circular cross-section.

* * * * *